US006783102B2

(12) United States Patent
Kirschner

(10) Patent No.: US 6,783,102 B2
(45) Date of Patent: Aug. 31, 2004

(54) FIRE SPRINKLER MOUNT

(75) Inventor: Kraig A. Kirschner, Corona, CA (US)

(73) Assignee: Automatic Fire Control, Incorporated, South El Monte, CA (US)

( * ) Notice: Subject to any disclaimer, the term of this patent is extended or adjusted under 35 U.S.C. 154(b) by 0 days.

(21) Appl. No.: 10/672,470

(22) Filed: Sep. 26, 2003

(65) Prior Publication Data

US 2004/0065788 A1 Apr. 8, 2004

Related U.S. Application Data

(63) Continuation of application No. 10/237,143, filed on Sep. 5, 2002.

(51) Int. Cl.[7] ..... A62C 13/76

(52) U.S. Cl. ..... 248/75; 169/37; 239/283; 248/300

(58) Field of Search ..... 248/70, 75, 300, 248/327, 342, 343; 239/282, 283; 169/43, 37, 16; 52/506.06, 506.07

(56) References Cited

U.S. PATENT DOCUMENTS

| | | | | |
|---|---|---|---|---|
| 3,995,823 A | | 12/1976 | Hensel | 248/327 |
| 4,346,863 A | | 8/1982 | Zeitrager et al. | 248/75 |
| 5,224,682 A | * | 7/1993 | Baughman | 248/651 |
| 6,508,410 B1 | | 1/2003 | Thomas et al. | 239/1 |

FOREIGN PATENT DOCUMENTS

| | | | |
|---|---|---|---|
| JP | 2-296949 | 12/1990 | 52/506.06 |
| JP | 2-363452 A | 12/1992 | 52/506.06 |

* cited by examiner

*Primary Examiner*—Ramon O Ramirez
(74) *Attorney, Agent, or Firm*—Fulbright & Jaworski L.L.P.

(57) ABSTRACT

A fire sprinkler mount including a base, a bracket and a screw mounting the bracket to the base. The base includes a support attachable to a beam with two arms extending therefrom. Support holes extend through the arms. The bracket includes two parallel plates spaced to receive a standard sprinkler fitting. A cradle is provided at one of the plates while a retaining hole is provided on the other. The screw is able to rotate within the support holes and is threaded to a mounting hole in the bracket for vertical adjustment of the bracket retaining the sprinkler fitting.

3 Claims, 4 Drawing Sheets

FIRE SPRINKLER MOUNT

This is a continuation application of U.S. patent application Ser. No. 10/237,143, filed Sep. 5, 2002 in the name of Kraig A. Kirschner, for which priority under 35 U.S.C. 120 is claimed. The disclosure of U.S. patent application Ser. No. 10/237,143 is incorporated herein by reference.

BACKGROUND OF THE INVENTION

The field of the present invention is mountings for fire sprinklers in buildings.

Fire sprinklers are commonly installed in buildings today. Safety regulations now require same in many applications. The sprinklers are most often installed in ceilings where the sprinkler head extends below the ceiling or is flush with the ceiling while the sprinkler fitting of which there are standard sizes is positioned in the space above the sprinkler head. The placement of the sprinkler head protruding or flush with the ceiling creates the need for locational adjustment. The adjustment may require displacement in the plane of the ceiling or vertically perpendicular to that plane.

In many applications, particularly in the home, the sprinkler system might include PVC pipe and fittings. Such components are typically glued together, requiring cutting and reassembling for adjustment. Further, the pipe is not as resistant to vibrational wear making it more easily damaged by metal fittings, clamps and the like. However, the piping tends to be more flexible than steel pipe or copper tubing. These attributes and detriments of PVC piping provide for reasonably easy locational adjustments but are less tolerant of being gripped and retained by conventional hardware.

SUMMARY OF THE INVENTION

The present invention is directed to a fire sprinkler mount which includes a base including a support, two parallel and mutually displaced arms extending from the support. The arms each have a support hole. These holes are mutually aligned. A threaded rod extends through the support holes. The mount further includes a bracket with a plate with a retaining hole therethrough to receive the fire sprinkler. There is also a mounting hole through the first plate to receive the threaded rod.

Accordingly, it is an object of the present invention to provide an improved adjustable mount for fire sprinklers. Other and further objects and advantages will appear hereinafter.

DETAILED DESCRIPTION OF THE PREFERRED EMBODIMENTS

Figure 1:
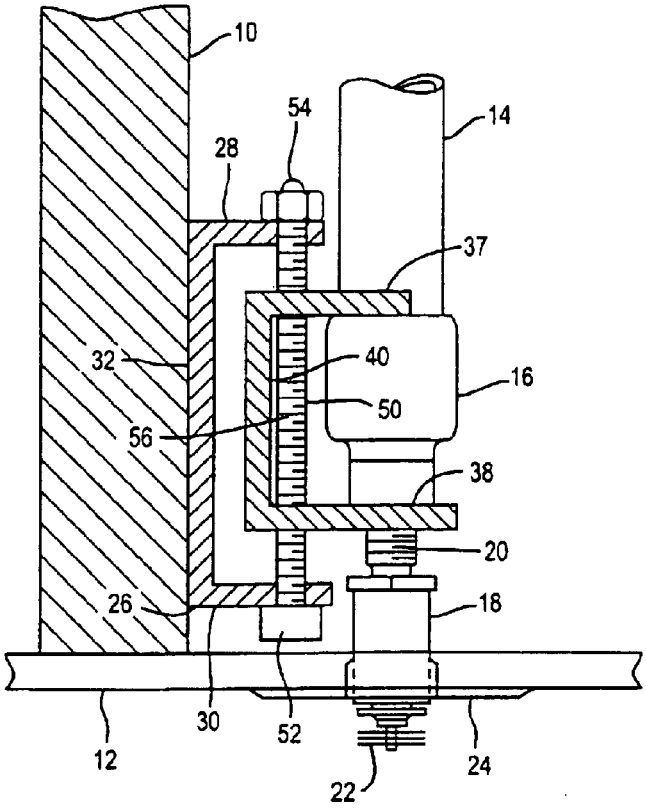
FIG. 1 is a side view of a fire sprinkler mount in place.
Figure 4:
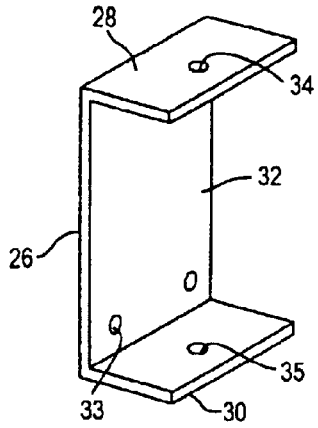
FIG. 4 is a perspective view of the base of the fire sprinkler mount.
Figure 5:
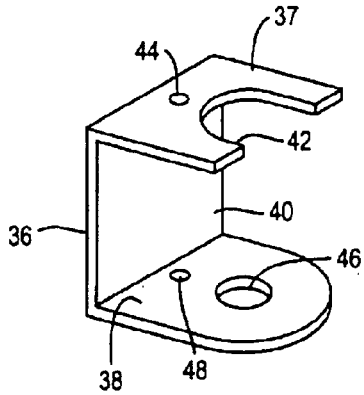
FIG. 5 is a perspective view of the bracket of the fire sprinkler mount.

Turning in detail to the figures, a first sprinkler mount is illustrated in FIG. 1 attached to a beam 10. The beam 10 lies immediately above a ceiling 12. A fire sprinkler pipe 14 extends downwardly from a sprinkler system raised above the ceiling 12. The pipe 14 terminates in a standard sprinkler fitting 16. This fitting 16 is, in this embodiment, two and one-half inches high. The pipe 14 and fitting 16 are typically PVC in residential construction and are permanently glued together. The fitting 16 is hollow with a threaded hole at the lower end thereof to receive a sprinkler head 18 to communicate water from the pipe 14 to the head 18 upon demand.

The sprinkler head 18 includes a threaded nipple 20 received in the threaded hole of the sprinkler fitting 16. The sprinkler head 18 includes a spray nozzle 22 which extends below the ceiling 12. A cover plate 24 finishes the hole through the ceiling 12.

The fire sprinkler mount includes a base 26 illustrated in FIG. 1. The base 26, illustrated in side view, is a flat plate with the ends thereof formed as shown to create an upper arm 28, a lower arm 30 and a support 32 between the upper and lower arms 28, 30. Fastener holes 33 are arranged in a pattern on the support 32 for mounting to the beam 10. The fastener holes 33 may be two in number laterally spaced to either side of the vertical centerline as shown. Additional fastener holes may be employed for added stability. The upper and lower arms 28, 30 have support holes 34, 35 aligned with one another. These holes 34, 35 are through holes without threads. They are located near the distal ends of the upper and lower arms 28 and 30 as can be discerned from the figures.

Figure 2:
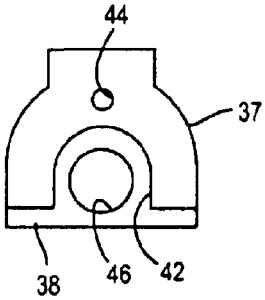
FIG. 2 is a top view of a first bracket.
Figure 3:
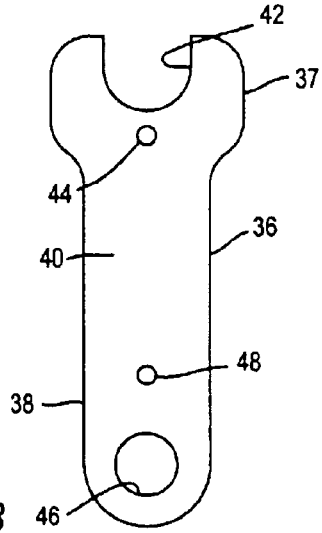
FIG. 3 is a plan view of a bracket with rounded features after being punched and prior to being formed on a break.

A bracket 36 is mounted to the base 26. The bracket 36 includes an upper plate 37 and a lower plate 38 with a web 40 therebetween. The bracket 36 is shown to be made from a punched plate with the upper and lower plates 37, 38 formed by a break to extend substantially at a perpendicular direction to the web 40. As the bracket 36 may be punched, the dye can define round corners and the like such as illustrated in FIG. 3 or retain a more angular structure as illustrated in FIG. 2.

The upper plate 37 includes a cradle 42 at the distal end of the plate 37. The cradle 42 of this embodiment has a semicircular surface and may have straight extensions at either ends as illustrated in FIGS. 2 and 3. The cradle 42 is sized to receive the fire sprinkler pipe 14 as illustrated in FIG. 1. A mounting hole 44 extends through the upper plate 37 near the proximal end thereof.

The lower plate 38 has a retaining hole 46 adjacent the distal end of the lower plate 38. The retaining hole 46 is sized to receive the threaded nipple 20 with a slip fit. The retaining hole 46 is aligned coaxially with the semicircular surface of the cradle 42. A mounting hole 48 is positioned adjacent the proximal end of the lower plate 38 and is aligned with the mounting hole 44 in the upper plate 37. In this embodiment, the mounting hole 44 is threaded and the mounting hole 48 is a through hole. The reverse may also be true. The two plates 37, 38 are spaced apart to define a distance therebetween which receives the standard sprinkler fitting 16. Such an installation is illustrated in FIG. 1.

A rod, or screw 50 ties the base 26 together with the bracket 36 and provides vertical adjustment therebetween. The rod 50 is illustrated to be a machine screw passing through the support hole in the lower arm 30, the mounting hole 48 in the lower plate 38, the mounting hole 46 in the upper plate 37 and the support hole in the upper arm 28 in seriatim. The screw 50 is threaded to whichever of the mounting holes 44, 48 which is tapped. As noted above, in this embodiment, the threaded hole is the upper mounting hole 44. The screw 50 defines shoulders at the rod ends thereof by an integral head 52 and a nut 54 at ends of the threaded shaft 56. The nut 54 may be a jamb nut or use other conventional techniques for allowing substantial rotation of the screw 50 without loosening or tightening the nut 54. The screw 50 is oriented with the integral head 52 at the bottom in order that a screwdriver or wrench may be applied through the ceiling for adjustment with removal of the cover plate 24.

In operation, the base 26 is mounted to the beam 10 in the location where the mount can appropriately place the sprinkler head 18 relative to the ceiling 12. The mount is either preassembled or is assembled with the base 26 in place. The fire sprinkler pipe 14 is typically flexible and the fitting 16 is positioned within the mount. The threaded nipple 20 of the sprinkler head 18 is extended through the retaining hole 46 and threaded into the fitting 16. The screw 50 is then rotated to vertically adjust the height of the sprinkler head 18 such that the cover plate 24 when positioned on the sprinkler head 18 is flush with the ceiling 12. The mount provides for a remodeling of the ceiling to define a new lower surface thereof by further adjustment to the vertical location of the bracket 36. Adjusting of the mount with this embodiment does not change the location of the screw head 52.

Figure 6:
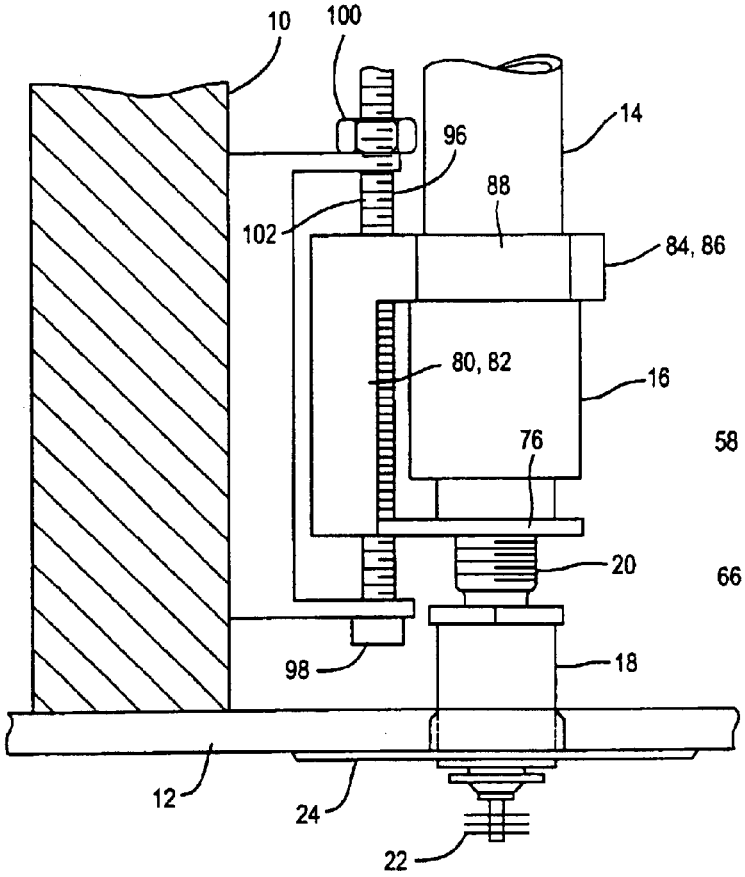
FIG. 6 is a side view of a second fire sprinkler mount in place.
Figure 7:
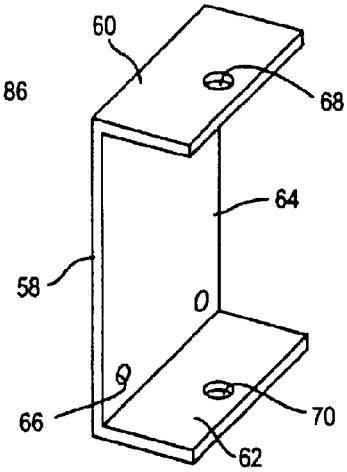
FIG. 7 is a perspective view of the base of the second fire sprinkler mount.
Figure 8:
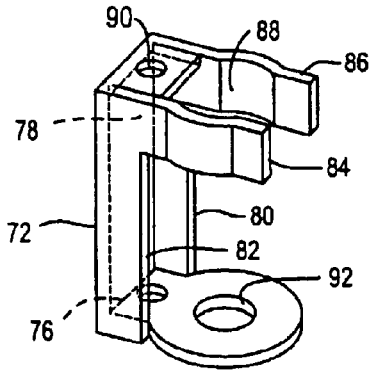
FIG. 8 is a perspective view of the bracket of the second fire sprinkler mount.

In the remaining three embodiments described below, the ceiling structure and fire sprinkler system are substantially identical and corresponding numbers are used for the same components. In the embodiment of FIGS. 6 through 8, the fire sprinkler mount again includes a base 58. The base 58 is a formed plate with the ends forming an upper arm 60 and a lower arm 62. A support 64 is arranged between the upper and lower arms 60, 62. Fastener holes 66 are located in the support 64 while support holes 68, 70 are found in the upper and lower arms 60, 62. The support holes 68, 70 are coaxial. Both of these support holes 68, 70 are through holes without threads. They are similarly located to the support holes 34, 35 of the first embodiment.

A bracket 72 is adjustably mounted to the base 58. The bracket 72 includes an upper plate 74, a lower plate 76 and a web 78 therebetween. In this embodiment, side plates 80, 82 are roughly perpendicular to the web 78 and to the upper and lower plates 74, 76. Fingers 84, 86 extend past the end of the upper plate 74. Each finger 84, 86 defining a saddle 88 concavely facing one another. These saddles 88 define segments of a circle for receiving and gripping pipe. As the saddles 88 only extend about a portion of the defined circle, an opening is presented both toward and away from the remainder of the bracket structure 72. The upper plate 74 includes a mounting hole 90. This hole in this embodiment is a through hole.

The lower plate 76 has a retaining hole 92 adjacent the distal end of the lower plate 76. The retaining hole 92 is aligned coaxially with the circle defined by the saddles 88. A mounting hole 94 in this embodiment is tapped for threads. This mounting hole 94 and the mounting hole 90 are aligned. The two plates 74 and 76 are spaced apart to define a distance which receives a contemplated standard sprinkler fitting 16.

A rod 96 adjustably joins the base 58 and the bracket 72. Again, the rod 96 is a machine screw passing through the support hole 70 in the lower arm 62, the mounting hole 94 in the lower plate 76, the mounting hole 90 in the upper plate 74 and the support hole 68 in the upper arm 60 in seriatim. The screw defining the rod 96 is threaded to the mounting hole 94. The screw 96 defines shoulders at the rod ends thereof by an integral head 98 and a nut 100 at ends of the threaded shaft 102. The screw 96 is oriented with the integral head 98 at the bottom in order that a screw driver or wrench may be applied through the ceiling for adjustment upon removal of the cover plate 24. The operation of this second embodiment is substantially that of the first embodiment.

Figure 9:
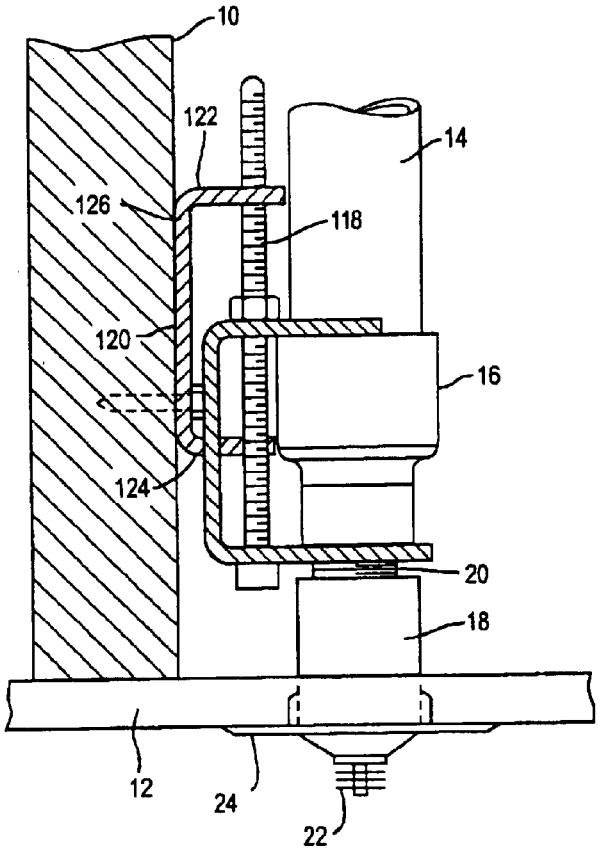
FIG. 9 is a side view of a third fire sprinkler mount in place.
Figure 11:
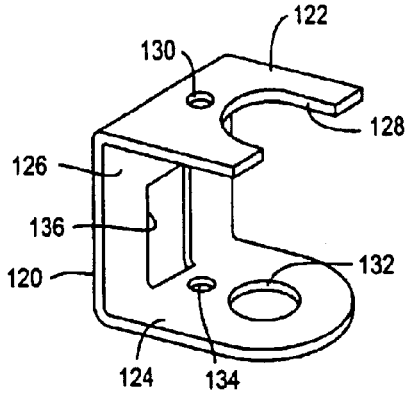
FIG. 11 is a perspective view of the bracket of the third fire sprinkler mount.
Figure 10:
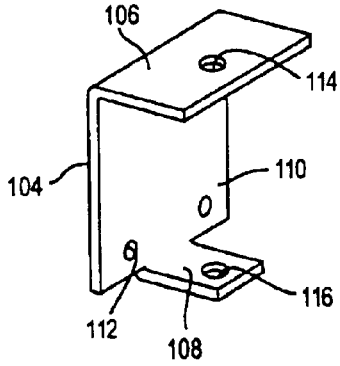
FIG. 10 is a perspective view of the base of the third fire sprinkler mount.

A third embodiment is illustrated in FIGS. 9 through 11. Again, a base 104 having an upper arm 106, a lower arm 108, a support 110 with fastener holes 112 and support holes 114, 116 aligned to receive a rod 118. However, in this embodiment, the lower arm 108 is substantially reduced in width as can be seen in FIG. 10 such that it is narrower than the support 110. In this embodiment, the lower support hole 116 is tapped for threads to receive an engage the rod 118. The support hole 114 is a through hole to receive the rod 118 without threaded engagement.

A bracket 120 is mounted to the base 104 through the rod 118. The bracket 120 includes an upper plate 122, a lower plate 124 with a web 126 between the two plates 122, 124. The space between the upper plate 122 and the lower plate 124 defines a distance therebetween which receives a standard sprinkler fitting 16.

The upper plate 122 includes a cradle 128 like that of the cradle 42 of the first embodiment. A mounting hole 130 extends through the upper plate 122 near the web 126.

The lower plate 124 includes a retaining hole 132 and a mounting hole 134 as in prior embodiments. The mounting holes 130, 134 are through holes to allow the rod 118 to rotate freely.

The web 126 includes a slot 136 therethrough. This slot is elongate toward the upper and lower plates 122, 124. The width of the slot 136 is sufficient to receive the lower arm 108 such that the lower arm 108 can move freely along the elongate direction of the slot 136. Indeed, it is the slot which is actually moving relative to the beam 10. In this embodiment, the rod 118 defined by a machine screw moves upwardly and downwardly with the bracket 120. Thus, the system provides additional clearance as adjustments are made upwardly.

Figure 12:
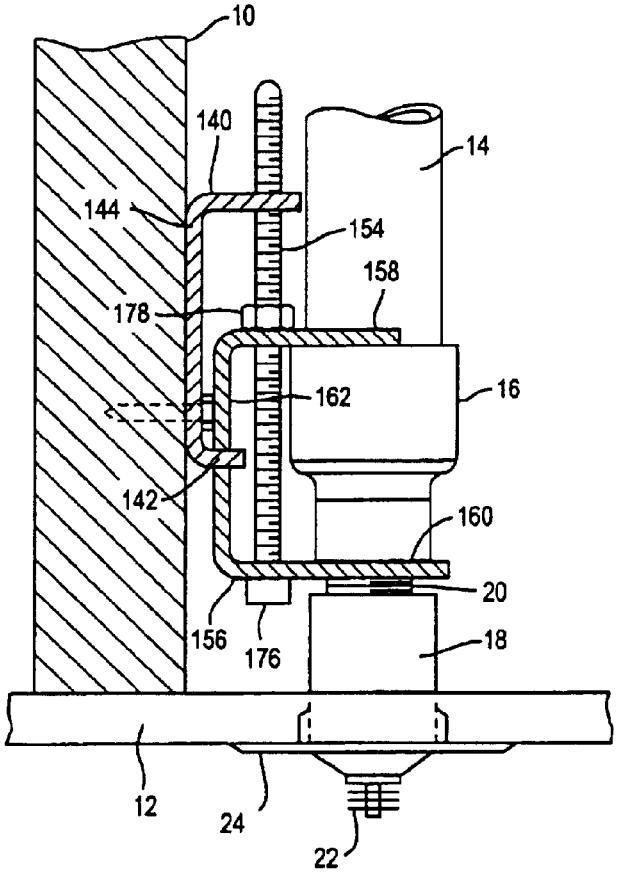
FIG. 12 is a side view of a fourth fire sprinkler mount in place.
Figure 14:
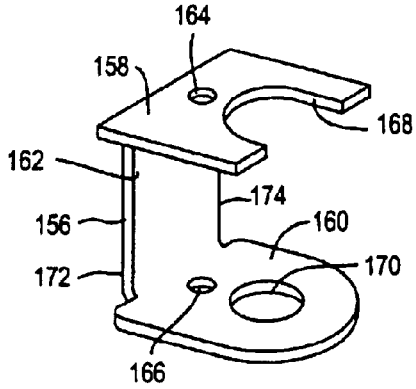
FIG. 14 is a perspective view of the bracket of the fourth fire sprinkler mount.
Figure 13:
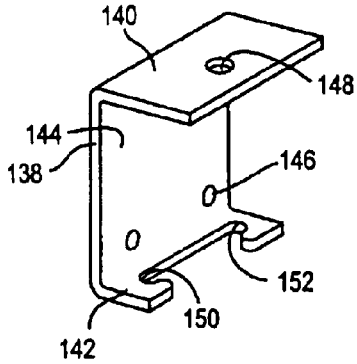
FIG. 13 is a perspective view of the base of the fourth fire sprinkler mount.

A fourth embodiment of the mount is illustrated in FIGS. 12 through 14. The base 138 is much as before with an upper arm 140, a lower arm 142 and a support 144. The support includes fastener holes 146 and the upper arm 140 includes a support hole 148. The lower arm 142 fails to have a lower support hole. Rather, the lower arm 142 is shortened and includes two guideways 150, 152 facing one another. The support hole 148 in this fourth embodiment is tapped for threads to threadably engage a rod 154. The bracket 156 includes an upper plate 158, a lower plate 160 and a web therebetween 162. The upper plate 158 and the lower plate 160 have mounting holes 164, 166, respectively. The upper plate 158 also has a cradle 168 as in prior embodiments while the lower plate 160 has a retaining hole 170, also as in the prior embodiments.

The web 162 includes parallel edges 172, 174 which are spaced to receive the guideways 150, 152. In this way, the bracket 156 is retained by and slides with the web 162 rather than the rod 154 as in prior embodiments.

The rod 154 includes an integral head 176 and a nut 178 to define the appropriate shoulders for retention of the connecting fastener axially fixed and rotational within the bracket 156. The rod 154 passes through the mounting hole 156 of the lower plate 160, the mounting hole 164 of the upper plate 158 and the threaded support hole 148 of the upper arm 140 of the base 138 in seriatim. For assembly, either the upper or lower plates 158, 160 are preferably relieved to allow the guideways 150, 152 to slide onto the web 162. As with the third embodiment, this fourth embodiment provides for the rod 154 to move upwardly with adjustment to provide additional clearance as may be needed.

Accordingly, an improved fire sprinkler mount is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A mount for a fire sprinkler comprising a base including a support, a first arm extending from the support and a second arm extending from the support parallel and displaced from the first arm, the first arm having a first support hole through the first arm and the second arm having a second support hole through the second arm and aligned with the first hole;

a bracket including a first plate with a first end and a second end, a retaining hole through the first plate adjacent the first end to receive a fire sprinkler, a first mounting hole through the first plate adjacent the second end; the bracket positioned entirely on a first side of the support and extending from the second end to the first end in a direction away from the support;

a threaded rod extending through the first support hole, the second support hole and the first mounting hole.

2. The fire sprinkler mount of claim 1, the first support hole and the second support hole being through holes, the first mounting hole being threaded on the threaded rod, the threaded rod including rod ends with shoulders not extendable through the first and second support holes.

3. The fire sprinkler mount of claim 2, one of the rod ends having a nut thereon defining one of the shoulders and the other of the rod ends having an integral head defining the other of the shoulders.

* * * * *